United States Patent [19]

Johnson

[11] Patent Number: 4,941,385

[45] Date of Patent: Jul. 17, 1990

[54] TONE PLATE AND CLAMPING DEVICE FOR A MUSICAL INSTRUMENT MOUTHPIECE

[76] Inventor: Conrad O. Johnson, 2414 Rosewood, Houston, Tex. 77004

[21] Appl. No.: 355,664

[22] Filed: May 22, 1989

[51] Int. Cl.[5] ..... G10D 9/02

[52] U.S. Cl. ..... 84/383 R

[58] Field of Search ..... 84/383

[56] References Cited

U.S. PATENT DOCUMENTS

| | | | |
|---|---|---|---|
| 1,449,868 | 3/1923 | Miller | 84/383 B |
| 1,575,621 | 3/1926 | Chiron et al. | 84/383 B |
| 3,618,440 | 11/1971 | Ratterree | 84/383 B |
| 4,210,055 | 7/1980 | Platamone | 84/383 B |
| 4,428,271 | 1/1984 | Winslow et al. | 84/383 B |

*Primary Examiner*—Lawrence R. Franklin

*Attorney, Agent, or Firm*—Pravel, Gambrell, Hewitt, Kimball & Krieger

[57] ABSTRACT

A tone plate and associated clamping device for positioning a reed against the mouthpiece of a single reed instrument. The tone plate has sharp edged triangular rails on its upper surface to contact the reed near its edges and allow the maximum freedom of vibration in the reed.

8 Claims, 1 Drawing Sheet

TONE PLATE AND CLAMPING DEVICE FOR A MUSICAL INSTRUMENT MOUTHPIECE

This invention is related to the invention disclosed in U.S. Pat. No. 4,745,838 to this inventor, filed on Mar. 23, 1987 and issued on May 24, 1988.

FIELD OF THE INVENTION

This invention relates to the field of single reed musical instruments and devices for attaching reeds to the mouthpieces of such instruments.

BACKGROUND

In a musical instrument having a reed mouthpiece, such as a saxophone or a clarinet, the sound produced by the instrument originates at the reed, which vibrates in an air stream produced from the mouth of the musician. As the reed vibrates, acoustic energy is transmitted from the reed to the airstream, which then passes through the instrument. Vibrations from the air stream are then transmitted from the walls and the horn of the instrument.

The musician controls the notes produced from the instrument by manipulation of keys, but the tone and character of the sound produced are largely determined at the mouthpiece. It is the way in which the reed interacts with the airstream and with the musician's embouchure that determines the characteristics of the tone produced.

A reed which vibrates more freely will generally produce a sound which is mellower or richer to the ear, often called a darker tone. Some reeds produce a sound with more of an edge, sometimes called a brighter tone.

Whether dark or bright, the tone produced by a reed in a particular mouthpiece on a particular instrument tends to persist through the entire range of the instrument. A darker tone is generally preferred by a concert musician while a brighter tone might be preferred by a jazz musician. Of course, any musician may wish to change from a dark tone to a bright tone between pieces, according to the nature of the music. Reeds are produced in varying degrees of flexibility so that the musician can select a reed which will produce the tone he desires. Very often, when a musician switches from one reed to another, he experiences a change in the responsiveness of the reed. More air or less air may be required, lip pressure may vary, tonguing of notes may become more or less sensitive, and the reed may in general be more or less responsive to the musician's technique.

Selection of the optimum reed, therefore, can be of major importance to the musician. Proper selection can be especially difficult for the novice, but it also continues to be of concern to the more accomplished musician. It is common for a musician to search for years for a particular brand, style and stiffness that fit his requirements for a reed. Even having found a reed he prefers, the musician often will sand or file a reed to fit his preference. This problem becomes more acute when one considers the fact that the characteristics of a reed change with use. As a reed gets older, it tends to experience changes in flexibility. Even during use, as the moisture content of the reed changes, its characteristics will also change. This can cause some difficulty in giving a performance as well as causing additional expense in frequent replacement of reeds.

It has long been recognized that a freely vibrating reed is desirable. Inventions attempting to achieve this end have been the subject, for instance of U.S. Pat. Nos. 1,060,946 (clarinet); 1,801,421 (ligature for reed instruments); 2,648,246 (ligature for musical instruments); 2,837,003 (ligature with flutings); 3,618,440 (ligature with inward flanges); 4,056,997 (ligature with variable thickness); 4,185,535 (ligature with grooves and string); 4,210,055 (ligature with adjustable contact member); and 4,275,636 (flexible tie ligature).

These previous devices fail to achieve the freedom of vibration which the present invention can achieve, producing a full, rich tone with a selectively bright or dark sound, while exhibiting a responsiveness heretofore unachieved.

The true tone of an instrument is best achieved by breathing from the diaphragm, to ensure a longer duration of each breath. Shallower breathing results in shorter breaths, failing to produce the best tone. Diaphragmatic breathing is easier for the accomplished musician than for the novice; therefore, the novice has more difficulty in producing the true tone of his instrument. The present invention, because it requires less air, enables the novice to more easily produce the best tone his instrument can produce. The invention also allows the accomplished musician to produce the best tone with less effort. Furthermore, the freedom of vibration achieved by the present invention allows a musician to continue using a reed long after it would otherwise have to be discarded.

SUMMARY OF THE INVENTION

In one aspect, this invention is a tone plate for use in a ligature, the tone plate having raised rails running longitudinally on its upper surface. The reed is placed on these rails with the fibers of the reed substantially parallel to the rails. The reed is then clamped against the mouthpiece by the ligature, with the tone plate between the reed and the ligature. Each rail has a relatively sharp edge at its apex, minimizing the area of contact between the rail and the reed. This edge must be sharp enough to minimize contact with the reed, while holding the reed in place, but not so sharp as to easily split the reed. This minimum contact, aligned substantially with the fibers of the reed, ensures that the reed has the maximum amount of freedom to vibrate, improving the tone and increasing the responsiveness of the reed. This freedom is also promoted by ensuring that the rails are spaced so as to contact the reed essentially at its edges, thereby maximizing the free vibration span in the reed.

In another aspect, this invention is a resilient mounting member between the tone plate and the ligature which ensures that the tone plate itself is not grounded on the ligature. This lack of a sound short between the tone plate and the ligature further enhances the freedom of vibration of the reed since the tone plate mass is relatively small, compared to the mass of the ligature, so the tone plate provides much less sound deadening inertia than would be present if the tone plate were grounded to the ligature.

In another aspect, this invention provides a transverse groove cut in the rails to achieve a brighter tone while still allowing the freedom of vibration which enhances reed responsiveness.

In another aspect, this invention provides the combination of a ligature with the tone plate, mounted by means of the resilient mount. This combination can also make use of a second tone plate mounted directly to the ligature, with rails substantially aligned with the rails on the first tone plate, and with a resilient mounting member between the first and second tone plates. This use of the second tone plate can further insulate the first tone plate because any vibrations passing through the resilient mount would largely be directed to the rails on the second tone plate.

DETAILED DESCRIPTION OF THE INVENTION

Figure 1:
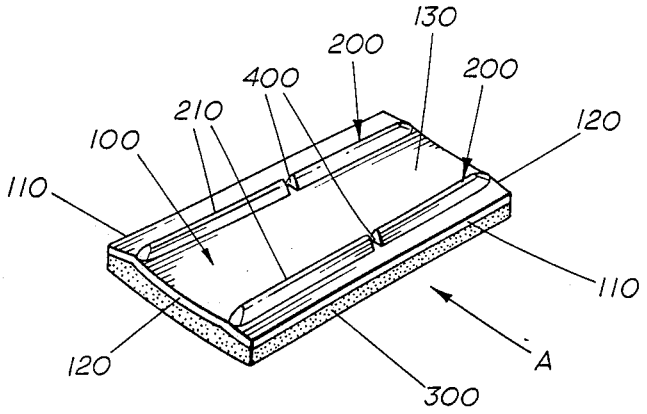
FIG. 1 is a perspective view of the tone plate of the present invention.

As seen in FIG. 1, tone plate A consists of support plate 100 which is a relatively thin sheet of material such as brass, preferably in a substantially rectangular shape, having two opposing parallel long edges 110 and two opposing parallel short edges 120. Typically, long edges 110 will be between 1 and 1 ⅛ inches in length, while short edges 120 will be between ½ and ⅝ inch in length. Rails 200 are approximately 1/16 inch in height. Long edges 110 can also be formed at a slight angle with each other, but still substantially parallel. When such an angle is present, the end of the plate having wider rail spacing is located toward the mouth of the musician, slightly increasing the freedom of vibration at the thin end of the reed.

Support plate 100 has upper surface 130 which is slightly concave between rails 200. Alternatively, upper surface 130 can be flat if desired, depending upon the height of rails 200. If rails 200 are tall enough, surface 130 would not necessarily need to be concave to avoid contact with the reed.

Figure 2:
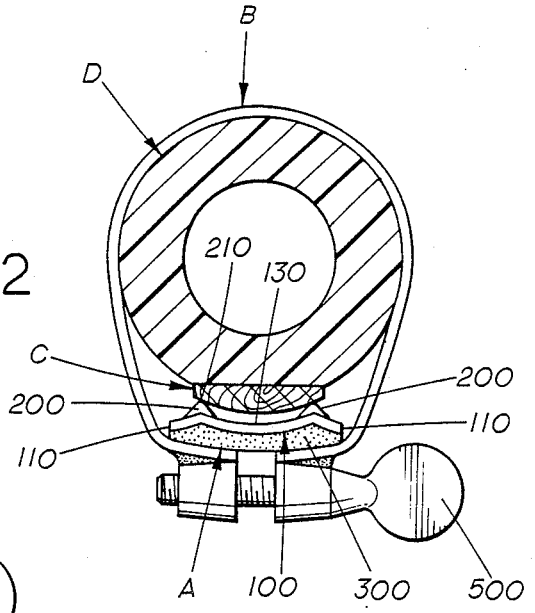
FIG. 2 is a sectional view of a mouthpiece incorporating a standard ligature and the tone plate of FIG. 1.

Rails 200 are longitudinal rails each having a generally triangular cross section. The apex 210 of the triangle is a relatively sharp edge. It is at apex 210 that rail 200 contacts the reed C as shown in FIG. 2. The sharpness of apex 210 ensures that contact between rail 200 and reed C will be minimal. Rail 200 is sufficiently tall that it will ensure that reed C does not contact the remainder of tone plate A. Adequate space must exist between reed C and upper surface 130 to insure that there will be no contact therebetween even if reed C swells as its moisture content increases during playing. The concavity of upper surface 130 assists in preventing contact between reed C and surface 130; it also can make tone plate A conform better to the shape of the ligature.

Again referring to FIG. 1, tone plate A has transverse slots 400 in rails 200. Slots 400 are optional, being provided for the purpose of brightening the tone of the instrument. Slots 400 can be near the center of rails 200 as shown, or they can be near one end or the other to produce a different tone. There can also be two or more slots 400 in each rail 200.

Support plate 100 rests on top of resilient mounting member 300, which can be made of a variety of soft materials suitable for insulation of sound vibrations, such as foam rubber, pliable plastic, or other elastomer, between tone plate A and ligature B as seen in FIG. 2. Mounting member 300 generally has a thickness of approximately one-sixteenth of an inch. A suitable material for resilient mounting member 300 has been found to be relatively thick double-backed tape. Use of this tape also provides a means of attaching the resilient mounting member 300 to both support plate 100 and ligature B. This enables the installment of tone plate A in any standard ligature B as shown in FIG. 2.

Still referring to FIG. 2, it can be seen that rails 200 are formed relatively near edges 110 of support plate 100, so as to contact reed C near its longitudinal edges. This spacing of rails 200 to the maximum width possible promotes the maximum freedom of vibration in reed C.

Resilient mounting member 300 attaches tone plate A to ligature B while preventing any direct contact between tone plate A and ligature B. Adjustment screw 500 is used to tighten ligature B onto mouthpiece D with reed C and tone plate A therebetween.

Figure 3:
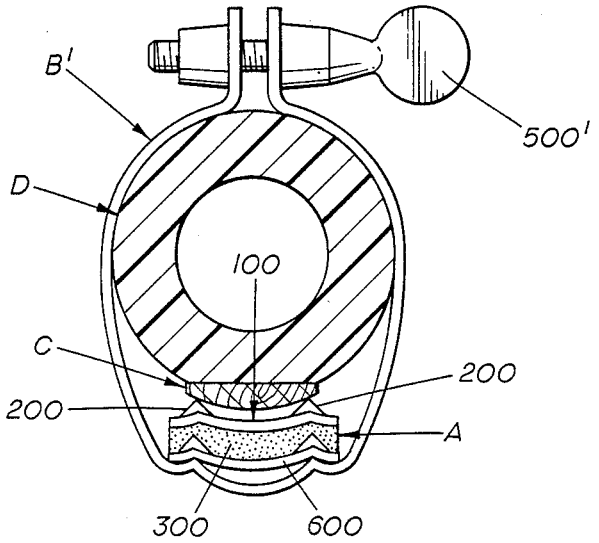
FIG. 3 is a sectional view of a mouthpiece incorporating a new ligature and tone plate according to the present invention.

As seen in FIG. 3, special ligature B', as described in U.S. Patent No. 4,745,838, can be used with the tone plate A of the present invention. Ligature B' provides a better mounting surface, namely second tone plate 600. Mounting tone plate A on top of second tone plate 600 further minimizes the influence of ligature B' on the vibration freedom of reed C. This is because any vibrations which penetrate resilient mounting member 300 are directed largely to the rails of second tone plate 600, rather than being transmitted directly to a large surface such as the inside of a standard ligature B as in FIG. 2.

The description given here is intended to be illustrative of the invention. Variations upon this embodiment will be apparent to those skilled in the art. To the extent that such variations are equivalent, it is intended that they be encompassed by the following claims.

I claim:

1. An improved tone plate for positioning a reed on a mouthpiece of a musical instrument, comprising:

a support plate for insertion into a reed clamping device;

a pair of longitudinal rails each of which is generally triangular in cross-section disposed on an upper surface of said support plate substantially parallel to the axis of the mouthpiece against which a reed can rest for positioning the reed against the mouthpiece;

an upper relatively sharp edge on the apex of each of said rails for contacting the reed and supporting the reed away from contact with any other part of the tone plate; and a resilient mount disposed on a lower surface of said tone plate.

2. The tone plate of claim 1, wherein the support plate is substantially rectangular, having two opposing long edges substantially parallel to the center axis of the mouthpiece and having two opposing short edges substantially perpendicular to the two long edges.

3. The tone plate of claim 1, wherein the support plate is a four sided polygon having two opposing parallel short edges and two opposing long edges, substantially parallel to the center axis of the mouthpiece, with a slight angle between the long edges.

4. The tone plate of claim 3, wherein a first rail of the pair of longitudinal rails is located near and substantially parallel to one of the two long edges of the support plate and a second rail of the pair of longitudinal rails is located near and substantially parallel to the other of the two long edges of the support plate.

5. The tone plate of claim 4, wherein the first and second rails are spaced apart so as to contact the reed substantially at the longitudinal edges of the reed.

6. The tone plate of claim 5, wherein the support plate upper surface is concave between the rails.

7. The tone plate of claim 1, further comprising a slot in each rail, transverse to the longitudinal axis of the rail.

8. An improved tone plate for positioning a reed on a mouthpiece of a musical instrument, comprising:

a substantially rectangular support plate for insertion into a reed clamping device;

first and second longitudinal rails, triangular in cross section, located on an upper surface of said support plate, with said first rail located near and substantially parallel to a first edge of said support plate, and with said second rail located near and substantially parallel to a second edge of said support plate opposite said first edge;

a sharp edge at the apex of each triangular longitudinal rail, for contacting the reed near the side edge of the reed and for supporting the reed against the mouthpiece away from contact with any other part of said tone plate;

wherein said upper surface of said support plate is concave between said rails; and a resilient mount disposed on a lower surface of said tone plate.

* * * * *